United States Patent [19]

Baltz et al.

[11] 4,327,041

[45] Apr. 27, 1982

[54] CARBURETOR HAVING A CONCENTRIC TUBE FUEL SUPPLY

[75] Inventors: Gene F. Baltz, Lake Villa; Paul W. Breckenfeld, Winthrop Harbor, both of Ill.

[73] Assignee: Outboard Marine Corporation, Waukegan, Ill.

[21] Appl. No.: 173,346

[22] Filed: Jul. 29, 1980

[51] Int. Cl.[3] ..... F02M 9/08

[52] U.S. Cl. ..... 261/41 B; 261/44 F

[58] Field of Search ..... 261/44 E, 41 B, 44 F

[56] References Cited

U.S. PATENT DOCUMENTS

| | | | |
|---|---|---|---|
| 1,038,040 | 9/1912 | Weiss | 261/44 E |
| 1,125,069 | 1/1915 | Coulter | 261/41 B |
| 1,393,366 | 10/1921 | Henderson | 261/41 B |
| 1,561,967 | 11/1925 | Buick | 261/44 F |
| 1,688,285 | 10/1928 | Purvis et al. . | |
| 1,743,368 | 1/1930 | Maybach | 261/44 F |
| 1,897,782 | 2/1933 | Wittlinger | 261/121 B |
| 2,047,661 | 7/1936 | Arff . | |
| 3,182,974 | 5/1965 | Hill . | |
| 3,640,512 | 2/1972 | Morgenroth | 261/121 B |
| 3,800,770 | 4/1974 | Baribeau et al. . | |
| 3,834,679 | 9/1974 | Baribeau et al. . | |
| 4,133,848 | 1/1979 | Black | 261/41 B |
| 4,190,032 | 2/1980 | Wright | 261/44 E |

FOREIGN PATENT DOCUMENTS

| | | | |
|---|---|---|---|
| 58608 | 11/1946 | Netherlands | 261/44 F |
| 205411 | 4/1923 | United Kingdom | 261/44 F |
| 1278292 | 6/1972 | United Kingdom | 261/44 E |

*Primary Examiner*—Tim R. Miles

*Attorney, Agent, or Firm*—Michael, Best & Friedrich

[57] ABSTRACT

Disclosed herein is a carburetor including a housing having a throat, means for supplying fuel to the throat intermediate its opposite ends, the fuel supplying means including a tube extending into the throat and including a plurality of fuel supply openings spaced along its length. A pivotable throttle member is positioned in the throat intermediate its opposite ends and is pivotable between a fluid flow restricting position and an open position. The pivotable throttle member includes a cam surface. The carburetor is also constructed such that an increased number of the openings supply fuel to the throat as the throttle member pivots from a fluid flow restricting position to an open position and the openings are closed as the throttle member pivots from an open position to a fluid flow restricting position. This is accomplished by a sleeve surrounding the tube and supported for slidable movement on the tube, and a cam follower engaging the cam surface, the cam follower carrying the sleeve whereby the sleeve is slideable on the tube in response to movement of the cam surface with respect to the cam follower.

2 Claims, 3 Drawing Figures

CARBURETOR HAVING A CONCENTRIC TUBE FUEL SUPPLY

FIELD OF THE INVENTION

The invention relates to carburetors and more particularly to a carburetor which includes a fuel supply tube extending into the carburetor throat, the fuel supply tube including a plurality of spaced apart fuel supply apertures and means responsive to movement of a throttle valve for controlling the number of fuel supply apertures which are open to thereby control the quantity of fuel supplied to the carburetor throat.

BACKGROUND PRIOR ART

An example of a prior art carburetor, employing means for varying the fuel supplied in proportion to movement of a throttle plate upstream of the fuel supply means, is illustrated in the U.S. Arff Pat. No. 2,047,661, issued July 14, 1936. Another prior art carburetor employing a tube extending into the carburetor throat wherein the tube includes a plurality of apertures for supplying fuel to the carburetor throat is shown in the U.S. Purvis et al. Pat. No. 1,688,285, issued Oct. 16, 1928.

Attention is also directed to the U.S. Hill Pat. No. 3,182,974, issued May 11, 1965; the U.S. Baribeau et al. Pat. No. 3,800,770, issued Apr. 2, 1974; and the U.S. Baribeau et al. Pat. No. 3,834,679, issued Sept. 10, 1974.

SUMMARY OF THE INVENTION

The invention includes a carburetor comprising a housing having a throat, and means for supplying fuel to the throat intermediate its opposite ends, the fuel supplying means including a tube extending into the throat, the tube including a plurality of fuel supply openings therein and spaced along its length. The carburetor also includes a pivotable throttle member positioned in the throat intermediate its opposite ends and pivotable between a fluid flow restricting position and an open position, the pivotable throttle member including a cam surface. Means are also provided for causing an increased number of the openings to supply fuel to the throat as the throttle member pivots from a fluid flow restricting position to an open position and for closing an increasing number of the openings as the throttle member pivots from an open position to a fluid flow restricting position. The closing means includes a sleeve surrounding the tube and supported for slideable movement on the tube, and a cam follower engaging the cam surface, the cam follower carrying the sleeve whereby the sleeve is slideable on the tube in response to movement of the cam surface with respect to the cam follower.

The invention also includes a carburetor comprising a housing including a throat and a pivotable throttle member positioned in the throat and pivotable between a fluid flow restricting position and an open position. The pivotable throttle member includes a cam surface. The carburetor also includes a tube extending into the throat intermediate its opposite ends, the tube including a plurality of fuel metering orifices spaced along its length, means for supplying fuel to the tube, and means for selectively preventing fuel flow through selected ones of the orifices. The carburetor further includes means for selectively causing movement of one of the tube and the fuel flow preventing means, such movement varying the fuel flow into the throat. The movement causing means includes a cam follower supported by the cam surface and connected to one of the tube and the fuel flow preventing means, and for causing its movement to open the orifices when the throttle member moves from the flow restricting position to the open position.

Various features and advantages of the invention are set forth in the following description of a preferred embodiment, in the drawings and in the claims.

Figure 1:
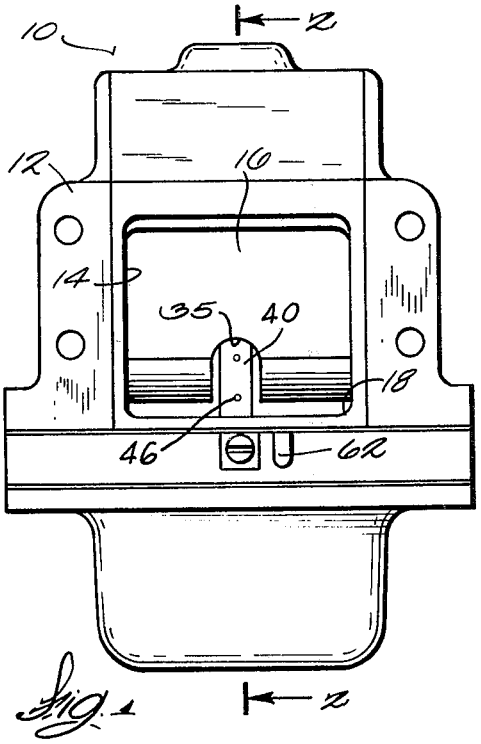
FIG. 1 is an end elevation view of a side draft carburetor embodying the invention.

Before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a side draft type carburetor 10 including a body 12 having a throttle bore 14. The carburetor also includes a throttle valve or throttle member 16 supported in the throat area 18 of the throttle bore 14 and for movement so as to control the air flow volume through the throat 18, the throttle valve 16 being pivotable about an axis 20 illustrated in FIG. 2 and between an idle position wherein the fluid flow through the carburetor throat 18 is restricted as shown in phantom lines in FIG. 2 and a position as shown in solid lines in FIG. 2 wherein the throttle valve 16 permits free flow of fluid through the carburetor throat, the airflow through the carburetor 10 being from left to right when viewed as in FIG. 2.

While the throttle valve 16 can have various constructions, in the particular arrangement illustrated, the throttle valve includes a generally planar face 22 and is supported for pivotal movement by support lugs 24 about axis 20, the support lugs 24 being located such that the axis 20 generally lies in the plane of the face 22 of the throttle valve and extends horizontally and perpendicularly to the direction of air flow through the carburetor throat 18. It will be noted that the axis of rotation 20 is adjacent an upper portion of the carburetor throat and that the housing 12 of the carburetor includes a housing portion 26 defining a recessed chamber 28 which is above the carburetor throat and above the axis of rotation 20 of the throttle valve 16 so as to house the throttle valve 16 when the throttle valve is rotated to an open position as illustrated in solid lines in FIG. 2. When the throttle valve 16 is in this position, the planar face 22 of the throttle valve 16 forms an upper wall of a portion of the throttle bore 14 and this upper wall portion is continuous with the remainder of the upper wall of the throttle bore 14.

The rearward surface 30 of the throttle valve 16, i.e. that surface portion of the throttle valve 16 facing in the direction of air flow through the throttle bore 16 when the throttle valve is in the closed position, includes an upper portion 32 which is rounded so as to generally conform with the rounded contour of the recess 28 and to permit rotation of the throttle valve. The throttle valve 16 also includes a central vertical groove 34 in its rear surface 30, the groove 34 generally bisecting the rearward and lower portions of the throttle valve and extending perpendicularly to the axis of rotation 20 of the throttle valve. As illustrated in FIG. 1, the throttle valve 16 also includes a semi-circular bore 35 formed in the lower portion of the throttle valve, as seen in FIG. 1, and extending from the lower face 22 and intersecting the central groove 34. The semi-circular bore 35 provides for a predetermined minimum air flow through the carburetor when the throttle valve is in the fully closed position.

Figure 2:
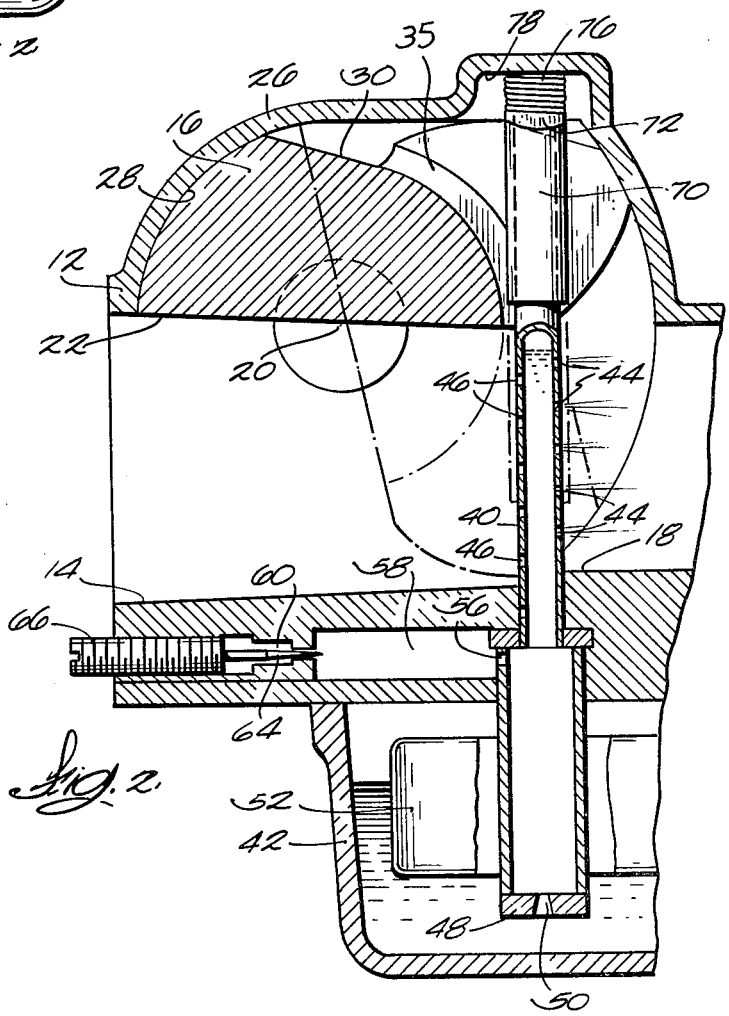
FIG. 2 is a cross section view taken generally along the line 2—2 in FIG. 1 and with portions broken away.

The extent of the relative movement of the throttle valve 16 is illustrated in FIG. 2. The throttle valve is shown in solid lines as being in the fully open position wherein the throttle valve is housed in the recess 28 and does not restrict air flow through the throat. The phantom lines indicate the throttle valve 16 in an idle position wherein air flow through the carburetor bore is limited to that flowing through the semi-cylindrical bore 35 in the lower portion of the throttle valve 16.

Means are also provided for supplying fuel to the carburetor throat 18 and for controlling the quantity of fuel supplied such that it is a function of the position of the throttle valve and the amount of air permitted to flow through the carburetor throat. In the illustrated construction, the means for supplying fuel to the carburetor throat includes a tube or conduit 40 which extends into the carburetor throat, the lower end of the tube 40 extending downwardly into a float bowl 42 adapted to contain liquid fuel. The tube 40 is housed in the groove 34 in the rear surface of the throttle valve 16 and generally bisects the carburetor throat and has a longitudinal axis extending generally perpendicular to the axis of rotation 20 of the throttle valve 16 as well as perpendicular to the direction of air flow through the carburetor. The end of the tube 40 which extends into the carburetor throat includes a plurality of small orifices 44 in its rearward surface, the small orifices facing in the direction of fluid flow through the carburetor. The tube 40 also includes a plurality of air inlet holes 46 in that portion of the tube which faces the up stream portion of the carburetor throat.

While various means can be provided for supplying liquid fuel to the tube 40, in the illustrated construction, the lower end of the tube extends into the float bowl 42. The lower end of the tube 40 is closed by a transverse wall 48, the transverse wall 48 having a small metering orifice 50 therethrough, the metering orifice 50 permitting fuel flow upwardly from the float bowl into the tube. A predetermined fuel level is maintained in the float bowl 42 by any conventional means such as a float 52 adapted to control a fuel supply valve (not shown).

In operation of the carburetor, air flow through the carburetor will result in a low pressure area being formed on the downstream side of the tube 40 and adjacent the discharge holes 44 of the tube thereby causing liquid fuel in the lower end of the tube 40 to be drawn upwardly and to be discharged through the discharge holes 44. The air inlet holes 46 function to permit air flow into the tube 40 causing emulsification of the liquid fuel with air and such that fine particles of liquid fuel are disbursed in the air and discharged through the discharge holes 44.

Additional means are also provided for supplying additional air to the tube 40 to control the quantity or rate of fuel flow into the tube, the air supplying means including means for adjusting the air flow volume into the tube. As illustrated in FIG. 2, this means includes an aperture 56 in the lower end of the tube 40 and above the level of the fuel in the float chamber 42. The aperture 56 communicates with air passages 58, 60 which are in turn connected with an air inlet 62 shown in FIG. 1. The air flow through the air passages 58 and 60 is controlled by a needle valve 64 operated by a screw 66. As the needle valve 64 is opened, thereby permitting an increased air flow through the passages 58 and 60 and into the tube 40, the amount of fuel drawn by the low pressure adjacent the discharge holes 44 of the tube 40 will decrease, thereby leaning the fuel mixture.

Figure 3:
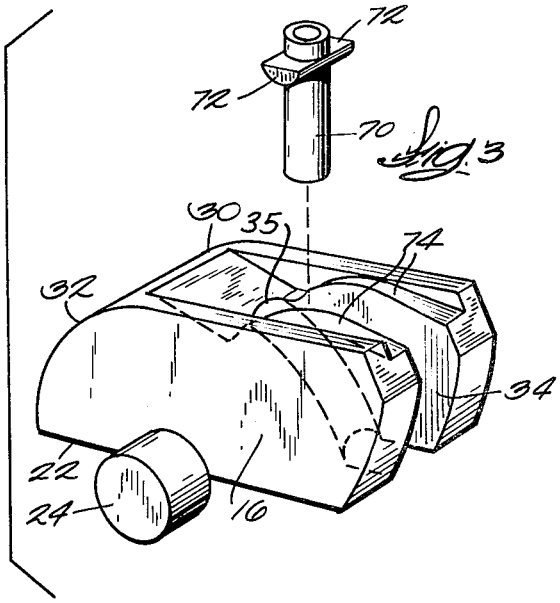
FIG. 3 is a perspective view of the rotating throttle valve of the carburetor illustrated in FIG. 1.

Means are also provided for controlling or varying the number of orifices 44 and 46 which are open as a function of the angular position of the throttle member 16, that controlling means functioning to close an increasing number of the air inlet holes 46 and fuel discharge orifices 44 as the throttle member 16 moves toward a flow restricting position and to open an increasing number of the air inlet holes 46 and discharge orifices 44 as the throttle member 16 moves from a flow restricting position to an open position. In the illustrated construction, such means comprises a sleeve or slider 70 which surrounds in coaxial relation the tube 40 and which is adapted to be slideably movable along the length of the tube 40 in response to movement of the throttle member 16. As best shown in FIG. 3, the upper end of the sleeve 70 includes a pair of outwardly extending cam followers 72 which are adapted to be slideably supported on the spaced apart cam surfaces 74 on the opposite sides of the central groove 34 in the rear surface of the throttle valve. The shape of the cam surfaces 74 is such that, as the throttle valve 16 is rotated from the closed position to an open position, the cam followers 72 and the sleeve 70, rigidly attached thereto, will be moved slideably upwardly on the tube 40. Such upward movement of the sleeve 70 causes an increasing number of the discharge holes 44 to be opened. The means for varying the number of orifices 44 which are open also includes a compression spring 76 which surrounds the upper end of the tube 40 and which is maintained in compression between an upper surface 78 of the housing portion 26 and the cam followers 72. The compression spring 76 is a light pressure return spring adapted to maintain the slider or sleeve in contact with the contour of the cam surface 74 to insure proper function of the slider or sleeve 70.

One of the advantages of the invention is that the amount of movement of the slider 70 is a function of the rotation of the throttle member 16, and the ratio of the fuel flow into the carburetor and the air flow through the carburetor can be controlled or selected by varying the contour of the cam surfaces 74. The discharge of fuel can also be accurately controlled as desired by variation of the size of the fuel outlet orifices 44 and their spacing as well as by the relative size and spacing of the air inlet holes 46. Fuel discharge at idle speeds can also be readily controlled by adjustment of the air bleed valve.

Various features of the invention are set forth in the following claims.

We claim:

1. A carburetor comprising a housing having a throat with opposite ends, a pivotable throttle member positioned in said throat intermediate said opposite ends and pivotable on a rotational axis between an open position and a fluid flow restricting position, said pivotable throttle member including a first surface partially forming said throat when said throttle member is in said open position and extending transversely of said throat when said throttle member is in said fluid flow restricting position, and a second surface removed from said throat when said throttle member is in said open position and facing downstream when said throttle member is in said fluid flow restricting position, said second surface including a pair of axially spaced cam surfaces extending partially circumferentially of and transversely of said rotational axis, said second surface also having therein a slot located between said cam surfaces and extending partially circumferentially of and transversely of said rotational axis, means for supplying fuel to said throat intermediate said opposite ends and including a conduit extending into said throat and said slot, said conduit including therein a plurality fuel supply openings spaced along the length thereof, and fuel flow control means for varying the number of said openings in fuel supplying communication with said throat in response to pivotable movement of said throttle member between said fluid flow restricting position and said open position, said fuel flow control means including a sleeve extending into said slot and supported for slidable movement in telescopic relation to said conduit, and cam followers extending fixedly in opposite directions from said sleeve in parallel relation to said rotational axis and in engagement with said cam surfaces, whereby said sleeve is slidable on said conduit in response to pivotable movement of said throttle member to vary the number of openings in fuel supplying communication with said throat.

2. A carburetor in accordance with claim 1 and further including a compression spring engaging said sleeve and urging said sleeve in the direction wherein said sleeve closes an increased number of said openings.

* * * * *